US009278531B1

(12) United States Patent
LeFevre et al.

(10) Patent No.: US 9,278,531 B1
(45) Date of Patent: Mar. 8, 2016

(54) PRINT HEAD PROTECTION DEVICE FOR INKJET PRINTERS

(71) Applicant: Xerox Corporation, Norwalk, CT (US)

(72) Inventors: Jason M. LeFevre, Penfield, NY (US); Douglas K. Herrmann, Webster, NY (US); Derek A. Bryl, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/539,516

(22) Filed: Nov. 12, 2014

(51) Int. Cl.
*B41J 25/308* (2006.01)
*B41J 2/145* (2006.01)

(52) U.S. Cl.
CPC ..... *B41J 2/145* (2013.01)

(58) Field of Classification Search
CPC ..... B41J 25/308
See application file for complete search history.

(56) References Cited

U.S. PATENT DOCUMENTS

| | | | | |
|---|---|---|---|---|
| 5,806,992 | A * | 9/1998 | Ju | G01B 21/08 250/559.27 |
| 6,734,417 | B2 * | 5/2004 | Vejtasa | 250/231.13 |
| 6,903,358 | B2 * | 6/2005 | Kim | 250/559.27 |
| 7,281,441 | B2 * | 10/2007 | Lee | 73/865.8 |
| 7,753,369 | B2 * | 7/2010 | Schalk | B65H 9/002 271/225 |
| 7,918,518 | B2 * | 4/2011 | Tanahashi | B41J 25/308 347/101 |
| 2002/0030706 | A1 * | 3/2002 | Nakanishi | B41J 11/20 347/8 |
| 2003/0122883 | A1 * | 7/2003 | Park | B41J 25/3088 347/8 |
| 2013/0050379 | A1 * | 2/2013 | Ebina | B65H 20/20 347/104 |

* cited by examiner

*Primary Examiner* — Stephen Meier
*Assistant Examiner* — John P Zimmermann
(74) *Attorney, Agent, or Firm* — Hoffmann & Baron, LLP

(57) ABSTRACT

A print head protection device is used with an inkjet printer having a print head adapted for elevating. A roller is mounted upstream of the print heads and above the process path a predetermined distance. A cover on the roller outer surface contacts the sheet lead edge if sheet curl exceeds a set curl range. The cover will cause rotation of the roller by engaging the sheet. A rotary encoder is mounted for synchronous rotation with the roller. The rotary encoder generates a signal in response to rotation of the roller, raising the print head to preclude damage. Alternately, the sheet can be discarded.

20 Claims, 7 Drawing Sheets

PRINT HEAD PROTECTION DEVICE FOR INKJET PRINTERS

INCORPORATION BY REFERENCE

Not applicable.

TECHNICAL FIELD

This invention relates to inkjet digital printing machines, and, more particularly, to an apparatus, system, and method for protecting the printing head from damage by impaction of media sheets in an inkjet digital printing machine.

BACKGROUND

Digital printing machines can take on a variety of configurations. One common process is that of electrostatographic printing, which is carried out by exposing a light image of an original document to a uniformly charged photoreceptive member to discharge selected areas. A charged developing material is deposited to develop a visible image. The developing material is transferred to a medium sheet (paper) and heat fixed.

Another common process is that of direct to paper ink jet printing systems. In ink jet printing, tiny droplets of ink are sprayed onto the paper in a controlled manner to form the image. Other processes are well known to those skilled in the art. The primary output product for a typical digital printing system is a printed copy substrate such as a sheet of paper bearing printed information in a specified format.

The output sheet can be printed on one side only, known as simplex, or on both sides of the sheet, known as duplex printing. In order to duplex print, the sheet is fed through a marking engine to print on the first side, then the sheet is inverted and fed through the marking engine a second time to print on the reverse side. The apparatus that turns the sheet over is called an inverter.

FIG. 1 shows a state-of-the-art inkjet digital printing machine 20. Printer 20 includes a marking module or engine 22 having an ink jet print head or multiple print heads 23, disposed centrally on the marking engine 22, and facing downward. Printer 20 has a media path 24 along which the media sheet 34 moves, and a media path entrance 26 where sheets are fed into the printer by a media sheet feeder (not shown). Printer 20 also has a media path exit 28 where sheets leave the printer and are fed into a finisher (not shown). Printer 20 has an inverter 30 to turn the sheet over for duplex printing. A media sheet 34 leaving the inverter 30 follows arrow 32 back to the marking engine 22 for printing on the reverse side. Arrows 26 and 28 also indicate the process path direction, which is downstream from entrance 26 toward exit 28.

In cut sheet printing devices, under certain conditions, the lead-edge of the paper can curl up and have potential for separating from the marking transport and contact the print head. A sheet with out-of-spec flatness can occur when a duplexed sheet has a heavy ink image on the trail edge of side 1, which then becomes the lead edge when inverted and curls towards Side 2. This is most severe when the paper is thin, and the cross-process direction image is parallel to the grain direction of the paper (Example: letter size paper, grain-long, long-edge-feed).

In direct-to-paper ink jet marking engines, an ink jet print head is mounted such that the face (where the ink nozzles are located) is mounted a fixed distance from the surface of the media. The gap is typically 1 mm or less. Because the paper curl height can be several millimeters, it poses a risk to the print head because it can hit the print head face plate when it passes through the nominally thin gap that the print heads are spaced from the media.

Ink jet print heads are very delicate and can easily be damaged if the face of the print head is contacted by the media which is passing nearby. The print heads are also very expensive. Thus, it is very important to minimize any risk of damaging these print heads.

Accordingly, there is a need to provide a print head protection device for inkjet printers that will detect media sheet curl and take remedial action to prevent print head damage.

There is a further need to provide a print head protection device for inkjet printers of the type described and that will match the high production rate of a digital printing machine.

There is a yet further need to provide a print head protection device for inkjet printers of the type described and that is mechanically simple and robust, thereby minimizing cost.

SUMMARY

In one aspect, a print head protection device is for use in connection with an inkjet printer having an inkjet print head, which is adapted for elevating. A media sheet has a lead edge and a trail edge. The media sheet moves in a process direction along a process path. The print head protection device comprises a roller having an axis of rotation disposed transverse to the process direction. The roller is mounted for free rotation above the process path. The roller has an outer surface disposed a predetermined distance "D" above the process path.

A cover is attached to the roller outer surface. The cover is adapted for traction against the sheet, to engage the lead edge of the sheet in the event of sheet curl in excess of a predetermined curl range. The cover will cause rotation of the roller by engaging the sheet.

A rotary encoder is mounted for synchronous rotation with the roller. The rotary encoder is adapted for generating a signal in response to rotation of the roller. A control system is operative to mitigate print head damage in response to the signal.

In another aspect, a print head protection device is for use in connection with an inkjet printer having an inkjet print head, which is adapted for elevating (moving the jetting surface of the print head away from the media). A media sheet has a lead edge and a trail edge. The media sheet moves in a process direction along a process path. The print head protection device comprises a roller having an axis of rotation disposed transverse to the process direction. The roller is mounted for free rotation above the process path. The roller has an outer surface disposed a predetermined distance "D" above the process path.

A cover is attached to the roller outer surface. The cover is adapted for traction against the sheet in a direction counter to the process direction. The cover will thus engage the lead edge of the sheet in the event of sheet curl in excess of a predetermined curl range. The cover will cause rotation of the roller by engaging the sheet.

A rotary encoder is mounted collinear with the roller for synchronous rotation with the roller. The rotary encoder is adapted for generating a signal in response to the roller cover engaging the sheet. The print head will elevate in response to the signal.

In yet another aspect, a method for print head protection is disclosed, and is for use in connection with an inkjet printer having an inkjet print head, which is adapted for elevating. A media sheet has a lead edge and a trail edge. The media sheet moves in a process direction along a process path. The method comprises mounting a roller for free rotation above the process path. An axis of rotation of the roller is disposed transverse to the process direction. An outer surface of the roller is disposed a predetermined distance above the process path.

A cover is attached to the roller outer surface. The cover is adapted for traction against the sheet. The lead edge of the sheet engages with the cover in the event of sheet curl in excess of a predetermined curl range. The roller is rotated by engaging the sheet.

A rotary encoder is mounted for synchronous rotation with the roller. A signal is generated with the rotary encoder in response to rotation of the roller. Print head damage is mitigated in response to the signal.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
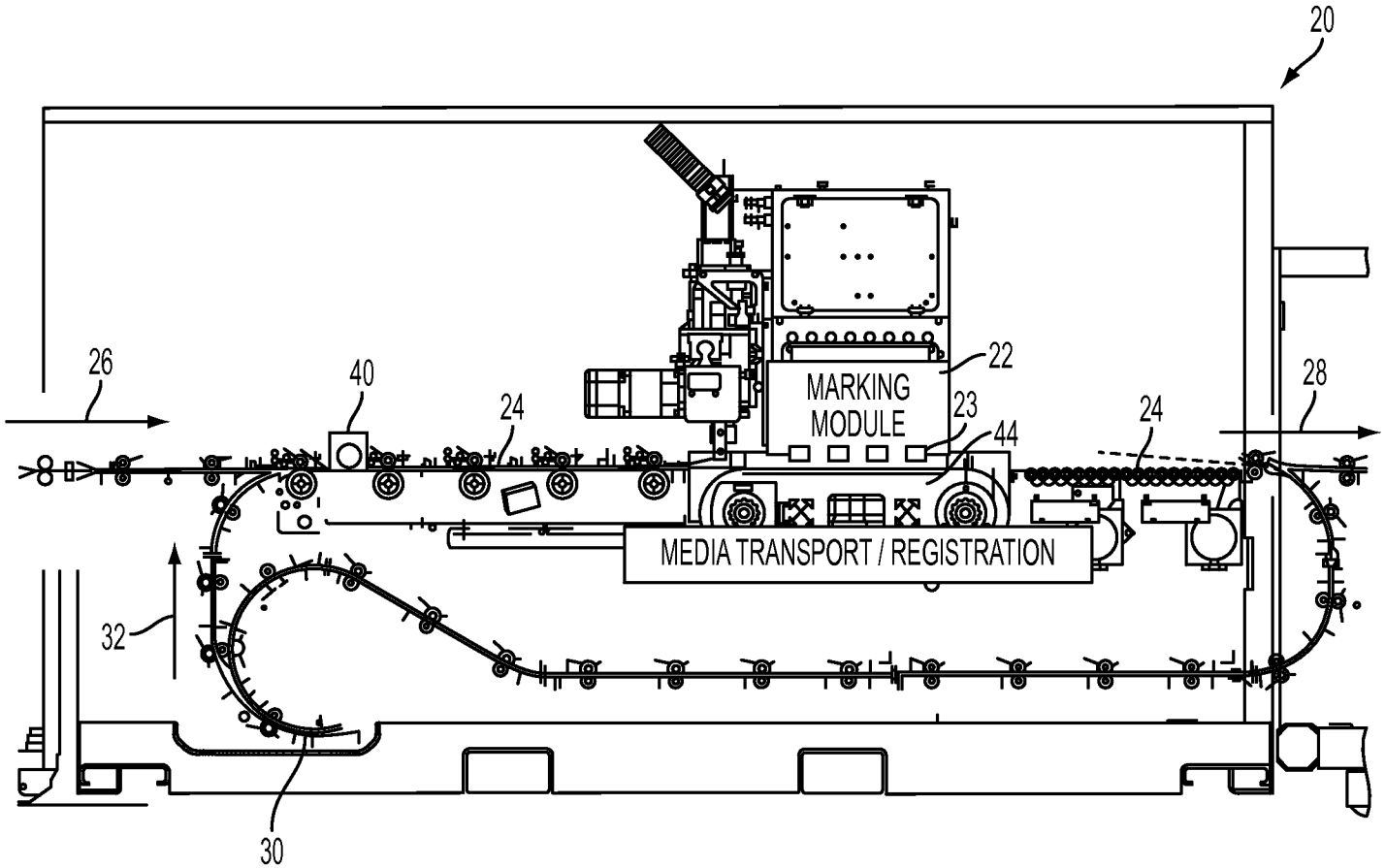
FIG. 1 is a schematic side elevational, sectional view of an exemplary production printer showing a print head protection device.

Describing now in further detail these exemplary embodiments with reference to the Figures as described above, the shuttling nip set sheet inverter is typically used in a select location or locations of the paper path or paths of various conventional media handling assemblies. Thus, only a portion of an exemplary media handling assembly path is illustrated herein. It should be noted that the drawings herein are not to scale.

As used herein, a "printer," "printing assembly" or "printing system" refers to one or more devices used to generate "printouts" or a print outputting function, which refers to the reproduction of information on "substrate media" or "media substrate" or "media sheet" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate to record and reproduce information, or other suitable processes for generating printouts, such as an ink jet process, a liquid ink process, a solid ink process, and the like. Also, such a printing system can print and/or handle either monochrome or color image data.

As used herein, "media substrate" or "media sheet" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any media substrate in the form of a sheet amounts to a reasonable equivalent thereto. Also, the "leading edge" or "lead edge" (LE) of a media substrate refers to an edge of the sheet that is furthest downstream in the process direction.

As used herein, a "media handling assembly" refers to one or more devices used for handling and/or transporting media substrate, including feeding, printing, finishing, registration and transport systems.

As used herein, the terms "process" and "process direction" refer to a procedure of moving, transporting and/or handling a substrate media sheet. The process direction is a flow path the sheet moves in during the process.

Referring to FIGS. 1-5, a print head protection device 40 is for use in connection with an inkjet printer 20 having an inkjet print head 23, or an array of print heads 23, which is located on a marking module or engine 22, which is adapted for elevating. A media sheet 34 has a lead edge 36 and a trail edge 38. The media sheet 34 moves in a process direction (from left to right in the drawings) shown by arrow 42, along a process path 24 on a sheet transport 44, such as a vacuum transport. The print head protection device 40 comprises a roller 46 having an axis of rotation disposed transverse to the process direction 42. The roller 46 is mounted for free rotation above the process path 24 and upstream of the inkjet print heads. The roller 46 has an outer surface 48 disposed a predetermined distance "D" above the process path. The roller predetermined distance above the process path is typically within the range of 0.50 mm to 1.0 mm, but can vary from 0.2 mm to 5.0 mm. The roller 46 will be contacted by the media sheet 34 when the sheet exceeds some maximum height from the vacuum transport, typically not more than 1 mm. The free-spinning roller 46 will turn and allow the sheet 34 to pass without jamming. Sheets of acceptable flatness will not contact the roller.

A cover 50 is attached to the roller outer surface 48. The cover 50 is adapted for traction against the sheet 34, to engage the lead edge 36 of the sheet in the event of sheet curl in excess of a predetermined curl range. The cover 50 will cause rotation of the roller 46 by engaging the sheet 34. The cover 50 preferably is made from a material that will exhibit traction on the sheet, especially in a direction counter to the process direction.

The cover 50 can be made from a wide variety of materials. Some examples are: one way felt; a material having elastomeric properties; a material having fibers projecting outward; a material having adhesive properties; and a material having electrostatic properties. The cover 50 is not restricted to these materials. The outer surface 48 of the roller 46 will preferably have the one-way felt cover material adhered to it, such that the grain of the felt will be opposite the process direction 42. This gives any out-of-spec paper the greatest opportunity for catching the roller surface in a consistent fashion.

A rotary encoder 52 is mounted for synchronous rotation with the roller 46. The rotary encoder 52 can be mounted collinear with the roller 46, coupled together or on the same shaft. Optionally, the rotary encoder 52 can be mounted adjacent to the roller 46 and connected by gears, a timing belt, or other connection known to those skilled in the art. The rotary encoder 52 generates a signal in response to rotation of the roller 46. The encoder synchronized with the roller will indicate the number of degrees of rotation that the roller made when it was contacted by an errant sheet, until the roller stops rotating.

A control system to mitigate print head damage is provided. The control system is operative in response to the signal. The control system can be embodied in hardware and/or software, and sensitive to any type of input signal. The control system can be operative of any mechanical element associated with the sheet path.

The mitigation typically will include one of two procedures. The print head 23 can be elevated in response to the signal. The curled sheet 34 then passes below the raised print head 23, while receiving additional printing. The print head drawer, which is mounted on vertical slides, could be raised slightly (perhaps as much as 5 mm) to allow the out-of-spec paper to pass through without contacting the print head. Alternatively, the media sheet 34 can be directed away from the process path 24 in response to the signal. The media sheet 34 is then moved to a tray (not shown) for waste.

The amount of curl is determined by a computer algorithm that compares the position of the sheet lead edge with the starting time of the roller rotation. This will vary with the height of the lead edge, which correlates with the amount of curl. Sensors (not shown) measure the position and speed of the sheet lead edge. The computer uses the sensor data and encoder signal to determine how far to raise the print head. In the event that the curl is excessive, the computer directs the sheet to the waste tray.

The rotary encoder will determine an approximate angular position of the roller when the roller engages the lead edge of the sheet. The rotary encoder will further determine an approximate angular position of the roller when the roller ceases rotation. The change in angular displacement will thereby indicate an approximate magnitude of sheet curl. This, in turn, will determine a distance to elevate the print head.

The sheet flatness detector roller will be mounted significantly upstream of the marking module 22 (while still in the duplex path) such that a sheet determined to be out-of-spec by the sensor can be mitigated before coming in contact w/the print heads 23. The physical mounting of the roller 46 will typically be ahead of the pre-marking registration module (at transport 44) in a production printer 20 as shown in FIG. 1. When placed in that location, the distance from the roller to the first head in the marking module is roughly 30". This means that the marking drawer has ~1 second at a nominal process speed of 33 ips to react to the detector indicating an out of spec sheet and raise up the ~5 mm to prevent a print head strike. The current marking drawer vertical actuator can make a 5 mm move up in ~200 ms, well under the 1 second (1000 ms) maximum available to make this move if needed.

Figure 2:
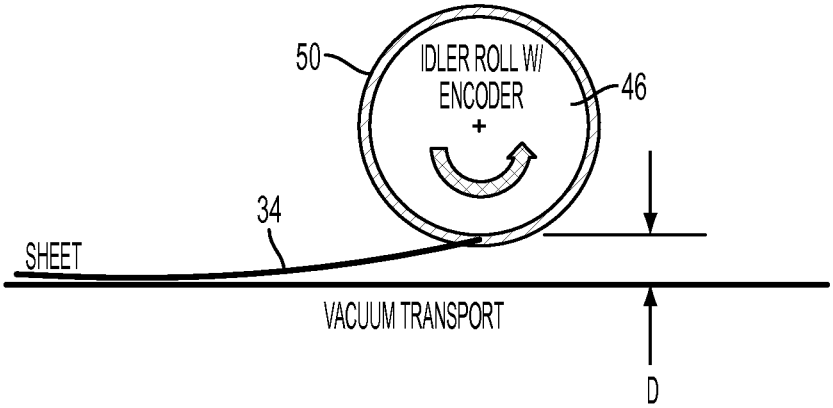
FIG. 2 is a schematic side elevational, sectional enlarged view of the print head protection device of FIG. 1, showing the media contacting the roll.
Figure 3:
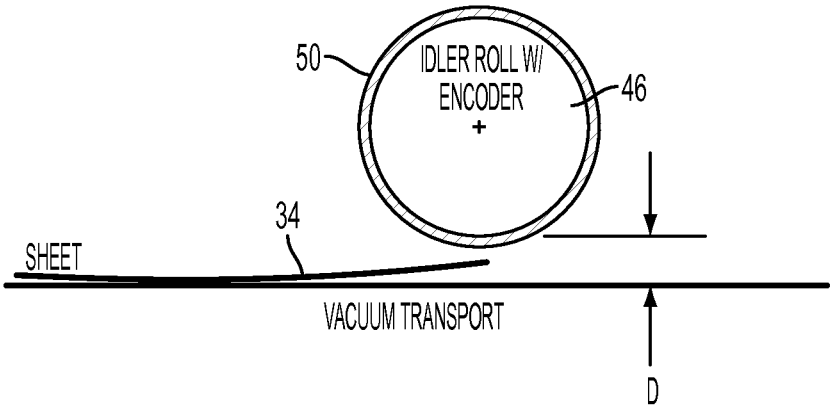
FIG. 3 is a schematic side elevational, sectional enlarged view of the print head protection device of FIG. 1, showing the media not contacting the roll.
Figure 4:
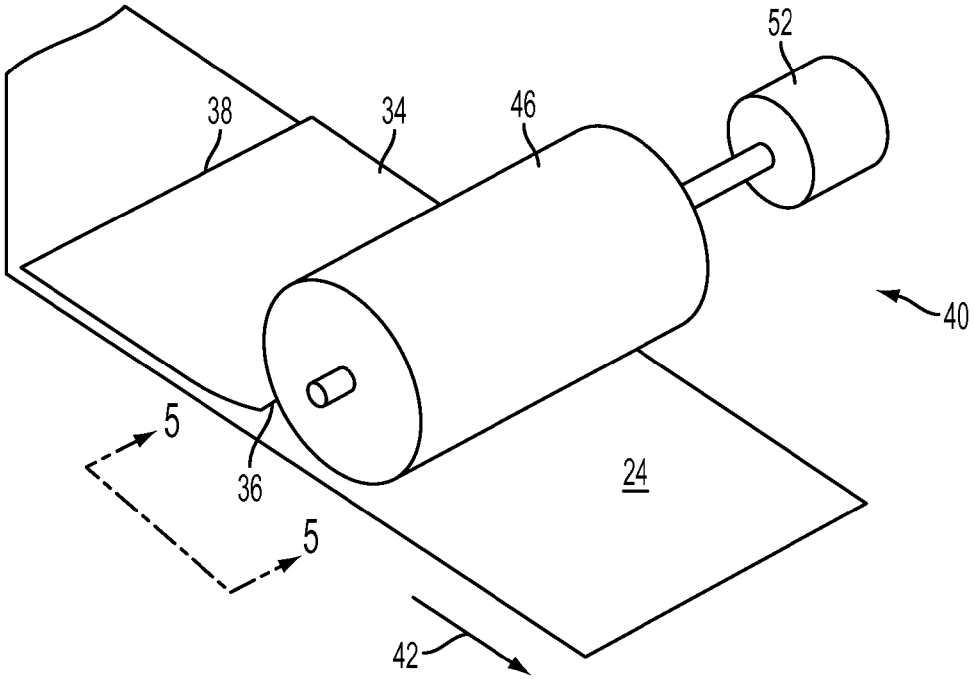
FIG. 4 is a perspective view of the print head protection device of FIG. 1, showing the sheet passing beneath the print head protection device of FIG. 1.
Figure 5:
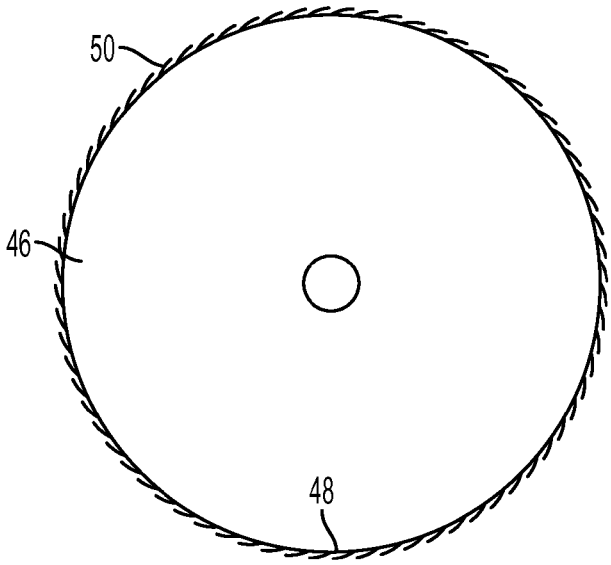
FIG. 5 is a schematic side elevational view of the roller of the print head protection device of FIG. 1.

FIG. 2 shows a sheet contacting the roller. FIG. 3 shows a sheet passing beneath the roller without contacting. A sheet passing through with moderate curl will be marked with some degree of image quality degradation, or "Xdp".

Figure 6:
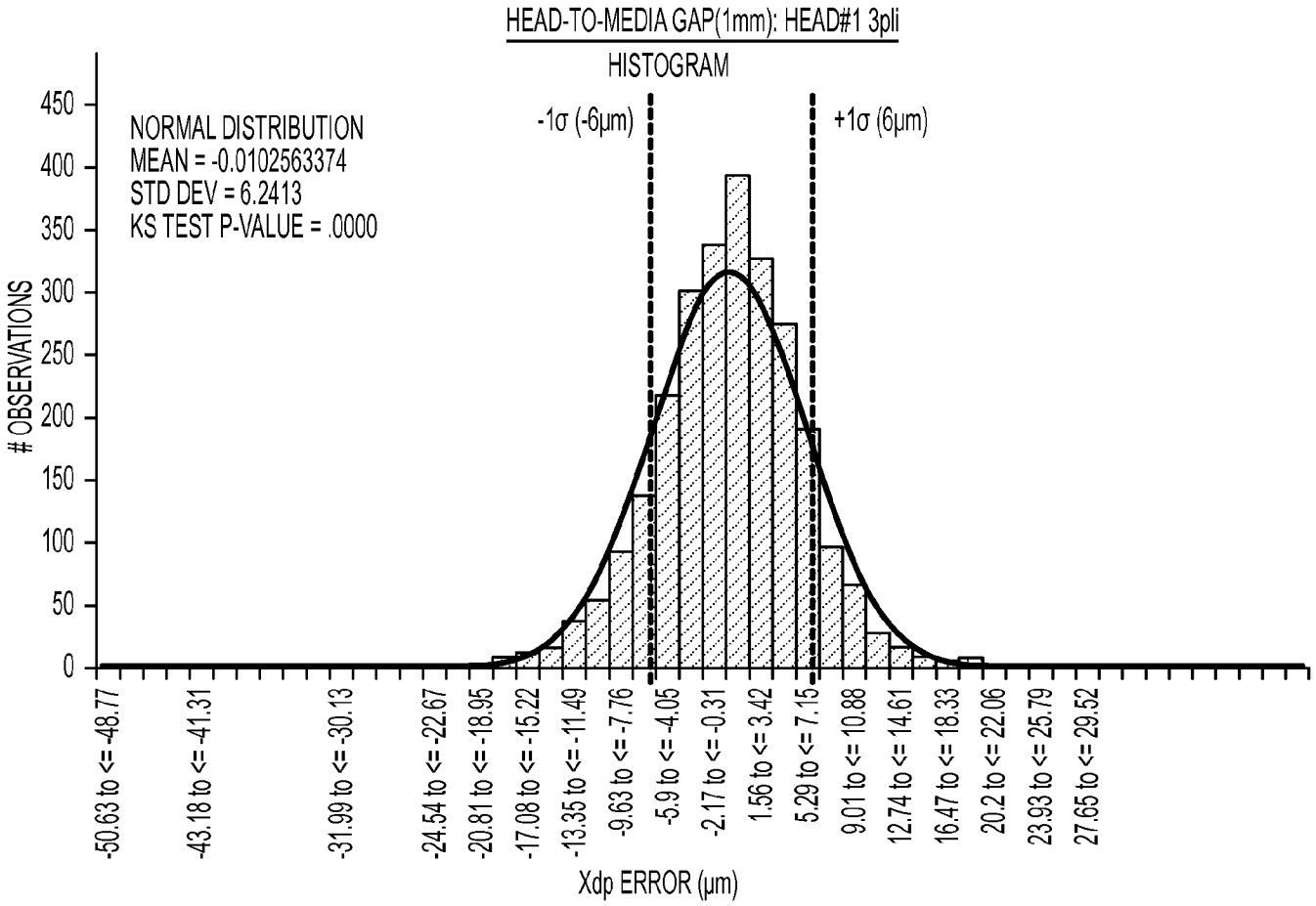
FIG. 6 is a graph of the Xdp (jetting) error distribution @ 1 mm head gap.

FIG. 6 shows the distribution of "Xdp" errors within an aqueous ink-jet print head at a nominal distance of 1 mm between the print head faceplate and the media. "Xdp" errors are the difference in displacement (in the cross-process or X direction) of an ink jet drop from the intended location on a page. An ideal ink jet drop would go perfectly straight, and would have consistent flight time, so that it could land exactly on the page where it was intended.

However, as seen here the drop placement errors ("Xdp" errors) are a function of the distance between the print head and the media. The distribution of "Xdp" errors was assessed for 1 mm, 2 mm and 3 mm spacing, and the error was found to be "normal" in distribution. The error had a 1σ (1-Sigma) value of 6-8 μm for 1 mm gap, 10-12 μm for a 2 mm gap, and a 12-17 μm 1-Sigma value for a 3 mm gap. This indicates that the drop placement error increases linearly with increasing head-to-media gap. As the marker drawer temporarily increases the head-to-media gap, higher levels of "Xdp" errors will occur. However, the visible level of image degradation is minimal and would be acceptable in some customer applications. Any temporary image distortion of one to three sheets is preferable to damaging a print head at the cost of $7000 per head or $40,000 per marking module.

Figure 7:
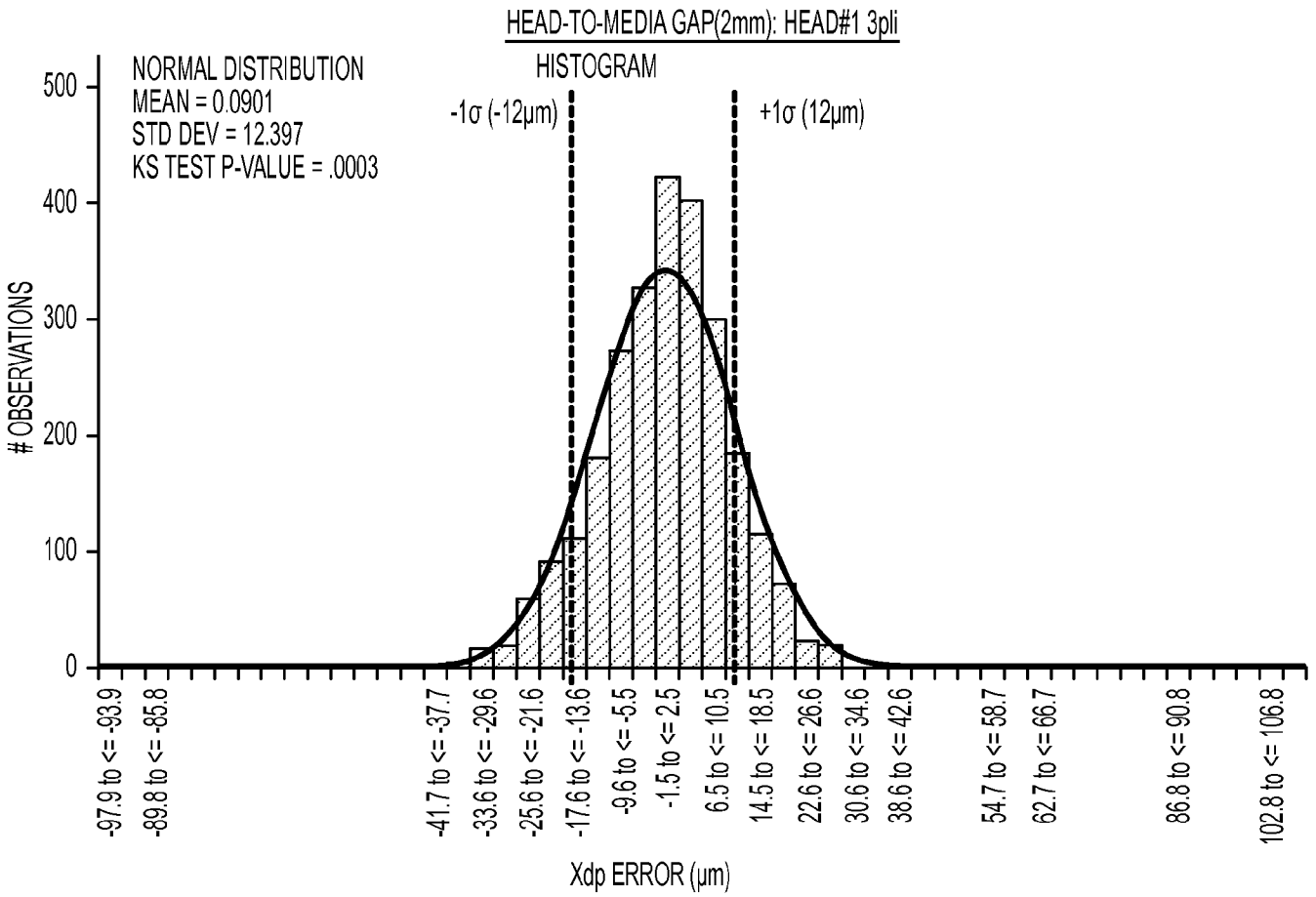
FIG. 7 is a graph of the Xdp (jetting) error distribution @ 2 mm head gap
Figure 8:
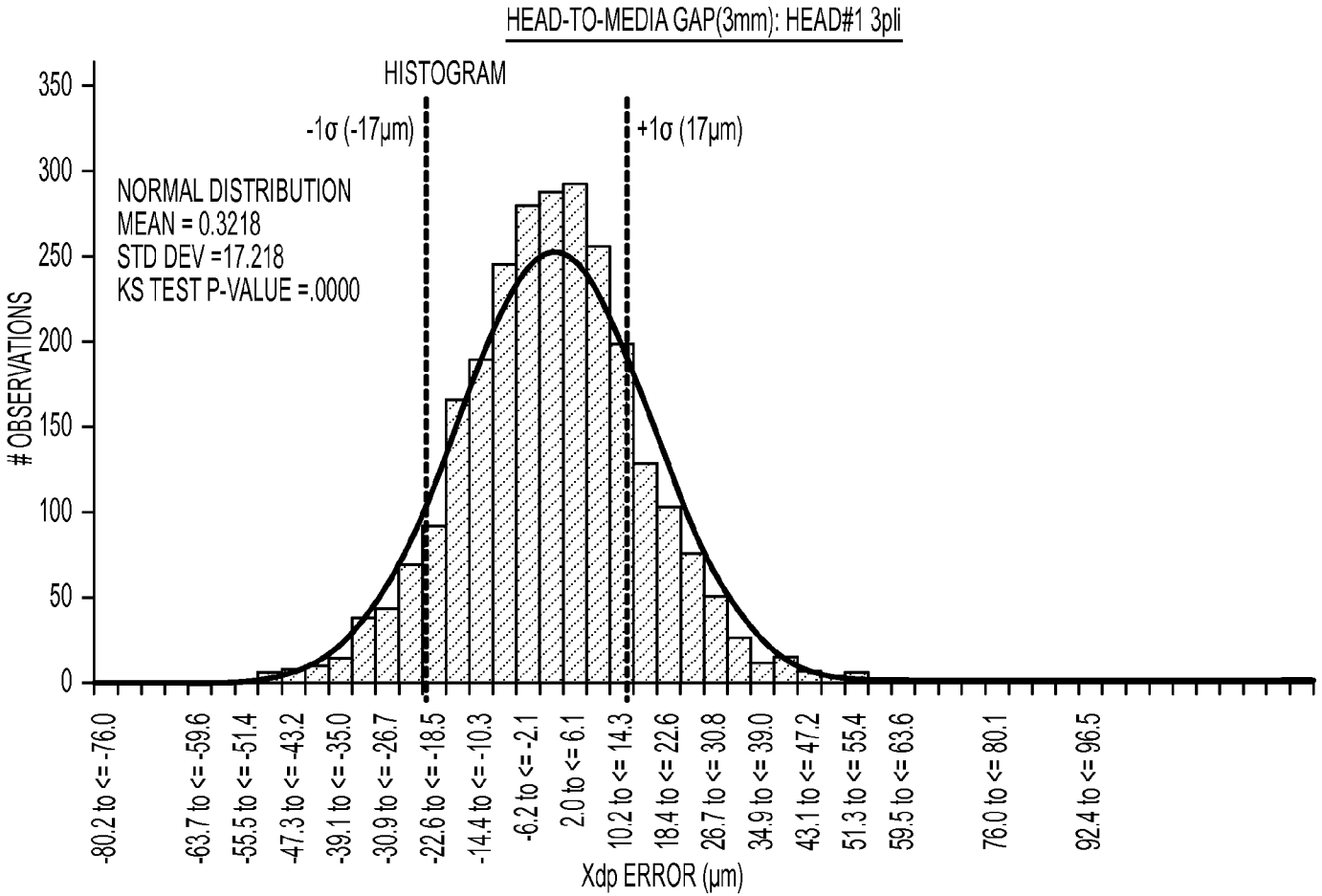
FIG. 8 is a graph of the Xdp (jetting) error distribution @ 3 mm head gap.
Figure 9:
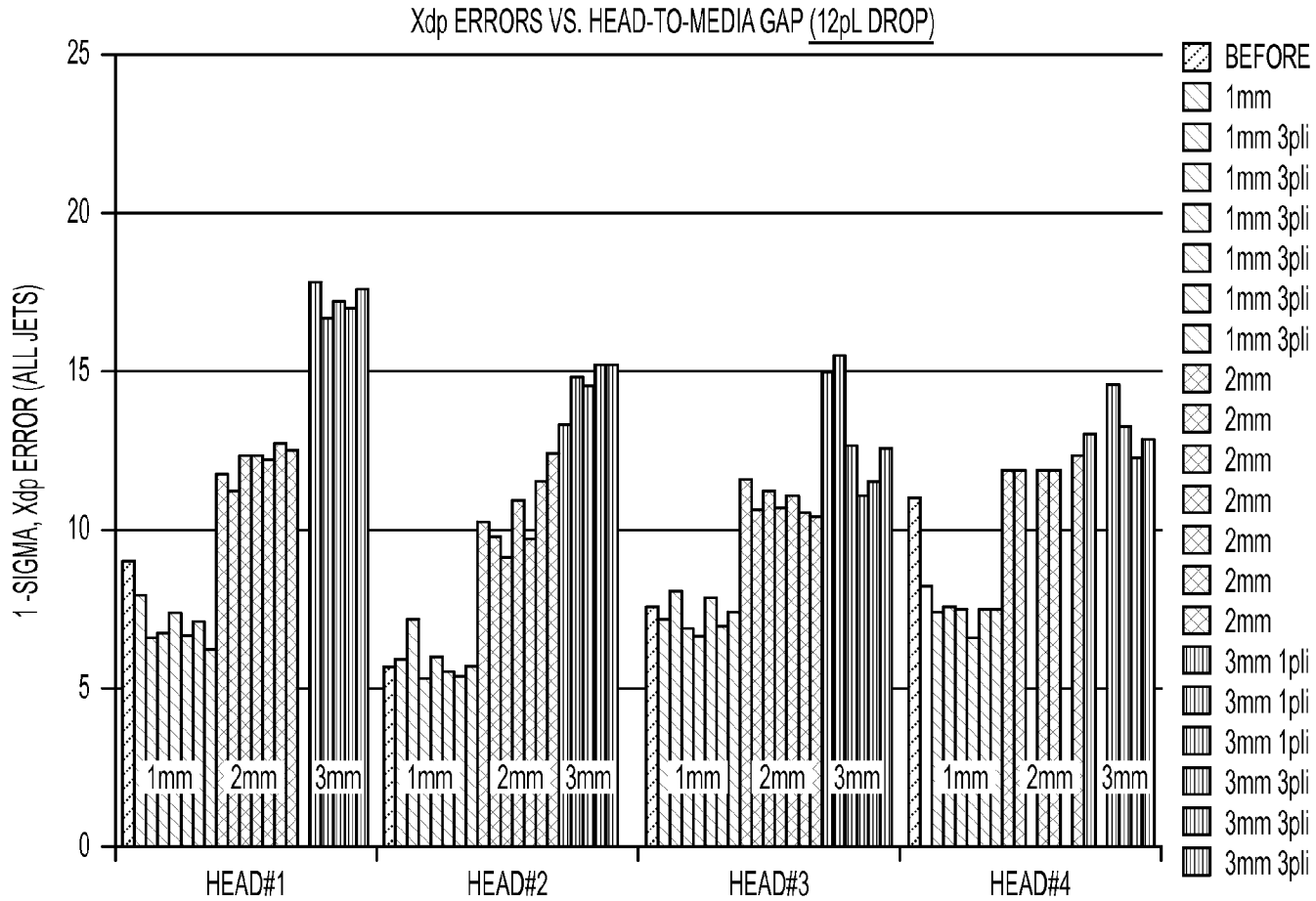
FIG. 9 is a bar graph of Xdp (jetting) error vs head to media gap.

Additional support of the claim above regarding the relationship between "Xdp" error and head-to-media displacement is shown in FIG. 7 and FIG. 8. Here the magnitude of the 1-Sigma value for the distribution of "Xdp" errors is plotted for 2 mm and 3 mm head-to-media gap respectively. Again, the general trend is that the "Xdp" error tends to increase as the gap becomes larger.

A method for print head protection is disclosed, and is for use in connection with an inkjet printer having an inkjet print head, which is adapted for elevating. A media sheet has a lead edge and a trail edge. The media sheet moves in a process direction along a process path. The method comprises mounting a roller for free rotation above the process path. An axis of rotation of the roller is disposed transverse to the process direction. An outer surface of the roller is disposed a predetermined distance above the process path. The roller is disposed above the process path a distance within the range of 0.50 mm to 1.0 mm. Alternative distances range from 0.40 mm to 2.0 mm and from 0.30 mm to 3.0 mm.

A cover is attached to the roller outer surface. The cover is adapted for traction against the sheet. The lead edge of the sheet engages with the cover in the event of sheet curl in excess of a predetermined curl range. The roller is rotated by engaging the sheet.

A rotary encoder is mounted for synchronous rotation with the roller. A signal is generated with the rotary encoder in response to rotation of the roller. Print head damage is mitigated in response to the signal. Mitigating print head damage further comprises either elevating the print head, or directing the media sheet away from the process path in response to the signal.

An approximate angular position of the roller is determined with the rotary encoder when the roller engages the lead edge of the sheet. An approximate magnitude of sheet curl is indicated with the change in angular position of the roller after engaging the sheet. The mitigation of the print head damage is determined by the magnitude of sheet curl.

The cover is adapted for traction against the sheet in a direction counter to the process direction. The cover is formed from a material selected from the group consisting of: one way felt; material having elastomeric properties; material having fibers projecting outward; material having adhesive properties; and material having electrostatic properties. The cover is not limited to these materials.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

| PART NO. | DESCRIPTION |
|---|---|
| 20 | printer |
| 22 | marking engine |
| 23 | print head |
| 24 | process path |
| 26 | media path entrance |
| 28 | media path exit |
| 30 | inverter |
| 32 | duplex media path |
| 34 | media sheet |
| 36 | media sheet lead edge |
| 38 | media sheet trail edge |
| 40 | print head protection device |
| 42 | process direction arrow |
| 44 | sheet transport |
| 46 | roller |
| 48 | roller outer surface |
| 50 | cover |
| 52 | rotary encoder |

What is claimed is:

1. A print head protection device for use in connection with an inkjet printer having an inkjet print head, the print head being adapted for elevating, and a media sheet having a lead edge and a trail edge, the media sheet moving in a process direction along a process path, the print head protection device comprising:

a roller having an axis of rotation disposed transverse to the process direction, the roller being mounted for free rotation above the process path, the roller having an outer surface disposed a predetermined distance above the process path;

a cover attached to the roller outer surface, the cover being adapted for traction against the sheet, so as to engage the lead edge of the sheet in the event of sheet curl in excess of a predetermined curl range, and to cause rotation of the roller by engaging the sheet;

a rotary encoder mounted for synchronous rotation with the roller, the rotary encoder being adapted for generating a signal in response to rotation of the roller; and a control system operative to mitigate print head damage in response to the signal.

2. The print head protection device of claim 1, further comprising:

the rotary encoder being adapted to determine an approximate angular position of the roller when the roller engages the lead edge of the sheet; and the rotary encoder being adapted to determine an approximate angular position of the roller when the roller ceases rotation, thereby indicating an approximate magnitude of sheet curl, so as to implement mitigation.

3. The print head protection device of claim 1, wherein the control system is adapted to elevate the print head in response to the signal.

4. The print head protection device of claim 1, wherein the control system is adapted to direct the media sheet away from the process path in response to the signal.

5. The print head protection device of claim 1, wherein the roller predetermined distance above the process path is within the range of 0.50 mm to 1.0 mm.

6. The print head protection device of claim 1, wherein the roller predetermined distance above the process path is within the range of 0.40 mm to 2.0 mm.

7. The print head protection device of claim 1, wherein the roller predetermined distance above the process path is within the range of 0.30 mm to 3.0 mm.

8. The print head protection device of claim 1, wherein the cover further comprises a material adapted for traction in a direction counter to the process direction.

9. The print head protection device of claim 8, wherein the cover further comprises a material adapted for traction selected from the group consisting of:

one way felt;

material having elastomeric properties;

material having fibers projecting outward;

material having adhesive properties; and material having electrostatic properties.

10. A print head protection device for use in connection with an inkjet printer having an inkjet print head, the print head being adapted for elevating, and a media sheet having a lead edge and a trail edge, the media sheet moving in a process direction along a process path, the print head protection device comprising:

a roller having an axis of rotation disposed transverse to the process direction, the roller being mounted for free rotation above the process path, the roller having an outer surface disposed a predetermined distance above the process path;

a cover attached to the roller outer surface, the cover being adapted for traction against the sheet in a direction counter to the process direction, so as to engage the lead edge of the sheet in the event of sheet curl in excess of a predetermined curl range, and to cause rotation of the roller by engaging the sheet; and a rotary encoder mounted collinear with the roller for synchronous rotation with the roller, the rotary encoder being adapted for generating a signal in response to the roller cover engaging the sheet, so as to elevate the print head in response to the signal.

11. The print head protection device of claim 10, further comprising:

the rotary encoder being adapted to determine an approximate angular position of the roller when the roller engages the lead edge of the sheet; and the rotary encoder being adapted to determine an approximate angular position of the roller when the roller ceases rotation, thereby indicating an approximate magnitude of sheet curl, so as to determine a distance to elevate the print head.

12. A method for print head protection for use in connection with an inkjet printer having an inkjet print head, the print head being adapted for elevating, and a media sheet having a lead edge and a trail edge, the media sheet moving in a process direction along a process path, the method comprising:

mounting a roller for free rotation above the process path;

disposing an axis of rotation of the roller transverse to the process direction;

disposing an outer surface of the roller a predetermined distance above the process path;

attaching a cover to the roller outer surface and adapting the cover for traction against the sheet;

engaging the lead edge of the sheet with the cover in the event of sheet curl in excess of a predetermined curl range;

rotating the roller by engaging the sheet;

mounting a rotary encoder for synchronous rotation with the roller;

generating a signal with the rotary encoder in response to rotation of the roller; and mitigating print head damage in response to the signal.

13. The method of claim 12, further comprising:

determining an approximate angular position of the roller with the rotary encoder when the roller engages the lead edge of the sheet;

indicating an approximate magnitude of sheet curl the with the change in angular position of the roller after engaging the sheet; and determining mitigating print head damage by the magnitude of sheet curl.

14. The method of claim 12, wherein mitigating print head damage further comprises elevating the print head in response to the signal.

15. The method of claim 12, wherein mitigating print head damage further comprises directing the media sheet away from the process path in response to the signal.

16. The method of claim 12, wherein disposing the outer surface of the roller a predetermined distance above the process path further comprises disposing the roller above the process path a distance within the range of 0.50 mm to 1.0 mm.

17. The method of claim 12, wherein disposing the outer surface of the roller a predetermined distance above the process path further comprises disposing the roller above the process path a distance within the range of 0.40 mm to 2.0 mm.

18. The method of claim 12, wherein disposing the outer surface of the roller a predetermined distance above the process path further comprises disposing the roller above the process path a distance within the range of 0.30 mm to 3.0 mm.

19. The method of claim 12, wherein adapting the cover for traction against the sheet further comprises adapting the cover for traction in a direction counter to the process direction.

20. The method of claim 19, wherein adapting the cover for traction further comprises forming the cover from a material selected from the group consisting of:

one way felt;

material having elastomeric properties;

material having fibers projecting outward;

material having adhesive properties; and material having electrostatic properties.

* * * * *